United States Patent [19]

Dickakian

[11] Patent Number: 4,883,581

[45] Date of Patent: Nov. 28, 1989

[54] PRETREATMENT FOR REDUCING OXIDATIVE REACTIVITY OF BASEOILS

[75] Inventor: Ghazi B. Dickakian, Houston, Tex.

[73] Assignee: Exxon Chemical Patents Inc., Linden, N.J.

[21] Appl. No.: 914,994

[22] Filed: Oct. 3, 1986

[51] Int. Cl.[4] ..... C10G 9/16

[52] U.S. Cl. ..... 208/48 R; 208/3; 208/4; 208/5; 208/7; 208/18; 208/39; 208/45; 208/96; 208/113; 208/116; 208/295; 208/177; 208/309; 208/290; 208/248; 585/950

[58] Field of Search ..... 208/309, 48 R, 3, 4, 208/5, 7, 18, 39, 40, 45, 96, 113, 116, 295, 177; 585/950

[56] References Cited

U.S. PATENT DOCUMENTS

| | | | |
|---|---|---|---|
| 1,744,574 | 1/1930 | Pew | 208/48 R |
| 1,788,792 | 1/1931 | Crothers | 208/48 R |
| 2,179,208 | 11/1939 | Burk et al. | 208/4 |
| 2,200,914 | 5/1940 | Burk et al. | 208/4 |
| 2,627,498 | 2/1953 | Fink et al. | 208/4 |
| 2,716,089 | 8/1955 | Cyphers et al. | 252/33.6 |
| 2,812,319 | 11/1957 | Jones | 260/132 |
| 2,847,353 | 8/1958 | Boavon | 208/48 R |
| 2,889,261 | 6/1959 | Pitchford | 208/41 |
| 3,061,538 | 10/1962 | Corbett | 208/39 |
| 3,095,377 | 6/1963 | Hart et al. | 252/45 |
| 3,153,622 | 10/1964 | Humphrey et al. | 204/154 |
| 3,159,571 | 12/1964 | Reman et al. | 208/39 |
| 3,161,584 | 12/1964 | Cleim | 208/251 H |
| 3,248,327 | 4/1966 | Whitaker | 252/52 |
| 3,297,589 | 1/1967 | Cleim | 208/251 R |
| 3,423,308 | 1/1969 | Murphy | 208/309 |
| 3,530,066 | 9/1970 | Kuwata et al. | 208/309 |
| 3,558,474 | 1/1971 | Cleim | 208/251 R |
| 3,657,111 | 4/1972 | Cleim | 208/251 R |
| 3,663,281 | 5/1972 | Fauber | 208/309 |
| 3,723,297 | 3/1973 | Gatsis et al. | 208/309 |
| 3,796,653 | 3/1974 | Gatsis et al. | 208/309 |
| 3,816,295 | 6/1974 | Coleman et al. | 208/309 |
| 3,847,751 | 11/1974 | Codino et al. | 208/39 |
| 3,859,199 | 1/1975 | Gatsis | 208/87 |
| 3,919,072 | 11/1975 | Pitchford et al. | 208/39 |
| 3,926,616 | 12/1975 | Mead et al. | 208/309 |
| 3,989,616 | 11/1976 | Pagen et al. | 208/87 |
| 4,125,458 | 11/1978 | Bushnell et al. | 208/309 |
| 4,358,365 | 11/1982 | Hutchings et al. | 208/309 |
| 4,396,493 | 8/1983 | Eilers et al. | 208/18 |
| 4,396,494 | 8/1983 | Eilers et al. | 208/309 |
| 4,397,733 | 8/1983 | Eilers et al. | 208/309 |
| 4,397,734 | 8/1986 | Eilers et al. | 208/309 |
| 4,427,531 | 1/1984 | Dickakian | 208/309 |
| 4,431,512 | 2/1984 | Dickakian | 208/44 |
| 4,493,765 | 1/1985 | Long et al. | 208/309 |
| 4,521,295 | 6/1985 | Chervenak et al. | 208/348 R |

FOREIGN PATENT DOCUMENTS

| | | | |
|---|---|---|---|
| 3300413 | 7/1983 | Fed. Rep. of Germany | 208/309 |

OTHER PUBLICATIONS

*Chemistry of Asphaltenes* Bunger editor 9/10–11/79, pp. 17–19 by Robert Blong "The Concept of Asphaltenes" (Advances in Chem. Series 195, American Chem. Society).

*Chemistry of Asphaltenes,* Bunger editor Sep. 10–11 1979, pp. 126–127 by Mieczyslaw M. Boduszynski "Asphastenes in Petroleum Asphalts" pp. 119, 126–127 (Advances in Chem. Series 195 American Chem. Society).

*Primary Examiner*—Helane Myers

*Attorney, Agent, or Firm*—J. B. Murray, Jr.; M. B. Kapustij

[57] ABSTRACT

Method of producing a baseoil having a reduced coking tendency by removing precursors from the baseoil. Baseoil having reduced coking tendencies which comprises a substantially no coking precursors therein.

26 Claims, 4 Drawing Sheets

PRETREATMENT FOR REDUCING OXIDATIVE REACTIVITY OF BASEOILS

FIELD OF THE INVENTION

The invention is directed to a method of reducing the oxidative reactivity of baseoils, and to baseoils produced by this method or otherwise, which exhibit low oxidative reactivity.

REFERENCE TO COPENDING APPLICATIONS

Reference is made to U.S. application Ser. No. 876,461, filed June 20, 1986 now U.S. Pat. No. 4,737,301, entitled: Polycyclic Thiophene Lubricating Oil Additive and Method of Reducing Coking Tendencies of Lubricating Oils; application Ser. No. 876,462, filed June 20, 1986, entitled: Method for Determining or Characterizing the Coking Tendencies of Baseoils, and Additive-Treated Oils; and application Ser. No. 876,460, filed June 20, 1986, entitled: Method of Preparing Baseoil Blend of Predetermined Coking Tendency, and Characterizing Effectiveness of Baseoil Additives; the disclosures of which are hereby incorporated by reference thereto.

DESCRIPTION OF BACKGROUND MATERIALS

Lubricating oils are widely used to reduce friction, protect against corrosion, and anticipate heat build-up in a variety of applications. Because such properties are seldom all achieved to a satisfactory degree using a lubricating oil alone, various additives have been developed for lubricating oil base stocks to improve their performance, e.g., anti-oxidants, viscosity index (VI) modifiers, flow improvers, corrosion inhibitors, etc.

Lubricating oils are a selected fraction of refined mineral oils used for the lubrication of (usually metallic) moving surfaces ranging from small precision machinery to the heaviest equipment. The oils generally contain small amounts of additives to impart desired properties such as viscosity and detergency, and range in viscosity from thin liquids to grease-like substances; unlike lubricating greases, they contain no solid or fibrous materials.

As used herein the term "lubricating oil" extends to a wide variety of oils having lubricative abilities including: automotive oils, heavy duty oils, marine oils, railroad oils, aviation lube oils, transmission fluids, hydraulic fluids, etc.

Lubricating oils are complex mixtures and, particularly when used in an internal combustion engine, are susceptible to breakdown caused by the high temperatures encountered during operation. While the chemistry of such breakdown is not fully understood, it is believed that oxidation plays a significant role, and for this reason it is known to add anti-oxidants to lubricating oils intended for such use.

The instant invention is directed to a technique which minimizes or entirely obviates the necessity of incorporating additives into baseoils for purposes of reducing engine build-up by virtue of the pretreatment which is performed. In effect, the pretreatment involves the removal of coking precursors from the baseoils. Although not performed for the same purpose, nor with the same objective, procedures do exist in which oils are treated for purposes of removing deposits and other undesired substances from oils.

Thus, removal is performed in certain processes which determine the amount of deposit removed as a measure of the tendency of the oil to coke.

U.S. Pat. No. 3,248,327 discloses one such technique which is a test known as a the Coker Detergency Test. This test is a modification of the Pratt and Whitney Test as described in United Stated Air Force Military Specification MIL-L-7808A. The test involves splashing the test oil in an air atmosphere against a heated aluminum panel for a given period of time and thereafter determining the amount of deposit formed on the panel. The oil is splashed onto the underside of an aluminum panel, and after a set period of time the test is stopped, and the aluminum panel is washed to remove excess non-coked oil. It is assumed that any increase in the weight of the panel, after washing and drying, must be due to coke formation on the aluminum. Similar techniques are disclosed in U.S. Pat. Nos. 3,095,377 and 3,153,622, and are identified as Panel Coker Tests meeting United States Air Force Specification MIL-L-9236A.

In yet another such testing technique deposits are removed, see U.S. Pat. Nos. 2,812,319 and 2,716,089. In these patents oil is heated in an aluminum measuring cup for a set period of time, after which the heated oil is permitted to settle without stirring. Thereafter the cycle is repeated a number of times, after which the oil is poured out of the cup, and the cup weighed to determine any increase in weight which would be indicative of coking.

The above techniques are clearly intended to be used only as small scale sampling techniques which permit one to determine the tendency of an oil to form coke deposits, by weighing the deposits formed in a sample.

Besides being treated for purposes of removing indicative amounts of coke deposits, oils have previously been treated also for the removal of asphaltene as part of well known techniques in the petroleum industry for removing metals which adhere to the asphaltene in petroleum residues. However, other than for purposes of removing metals, asphaltenes themselves were not previously removed on a regular basis as a technique for reducing the coking tendency of baseoils. Thus, where metals removal is either not a concern, or is performed by other techniques, there would previously have been no reason for removing the asphaltenes.

SUMMARY OF THE INVENTION

The invention is broadly directed to a method of reducing the oxidative reactivity, also described as coking tendency, of baseoils by removing coking precursors from the baseoils, and to baseoils of low oxidative reactivity.

The particular coking precursors to which this embodiment of the invention is directed are asphaltenes, especially $C_7$-asphaltenes.

Broadly, the invention is directed to reducing such coking tendency in a baseoil by the steps of:

(a) subjecting the baseoil to conditions which accelerate asphaltene formation from coking precursors in the baseoil; and (b) removimg asphaltene formed in step (a) from the baseoil.

Asphaltene formation can be accelerated in step (a) by any of several means.

One of such means comprises oxidizing and heating the baseoil, preferably by continuous oxidation at approximately 240°-360° C.

Asphaltene formation can be further accelerated by catalytic reaction of the baseoil. Any suitable catalyst, such as a Friedel-Craft catalyst, may be employed. The preferred catalyst is selected from a group consisting of ferric chloride hexahydrate, cobalt octoate, iron naphthenate, stannic chloride, and mixtures thereof. Most preferably, this catalytic reaction is carried out at a temperature of 180°-280° C.

Asphaltene formation can yet further be accelerated by reacting the baseoil with a material selected from the group consisting of peroxides, hydroperoxides, oxidized lube oils, and mixtures thereof. Any of these materials can also be added in the previously discussed catalytic reaction.

Any of these techniques for accelerating asphaltene formation can be performed while sparging the baseoil with an oxidizing gas selected from the group consisting of air, oxygen, ozone, nitrogen oxides (such as nitric oxide), sulfur oxides, and mixtures thereof; preferably, the baseoil is sparged with air at 1-10 standard cubic feet of air per hour. Most preferably, a mechanical agitator is used to agitate the baseoil during this sparging.

The asphaltene may be removed from the baseoil by distillation, to produce a light fraction substantially free of the asphaltene.

The asphaltene formed in step (a) can also be removed by contacting the baseoil with a liquid antisolvent which is miscible with the baseoil, and which also has a higher insolubility for the asphaltene than the baseoil does. The antisolvent may be one or more polar solvents, one or more hydrocarbon solvents, or blends thereof. Addition of the liquid antisolvent results in precipitation of the asphaltenes which may subsequently be more easily removed, such as for example by centrifugation.

The invention is further broadly directed to baseoils exhibiting low oxidative reactivity, including baseoils prepared by the method of the invention.

DETAILED DESCRIPTION OF PREFERRED EMBODIMENTS

Figure 1:
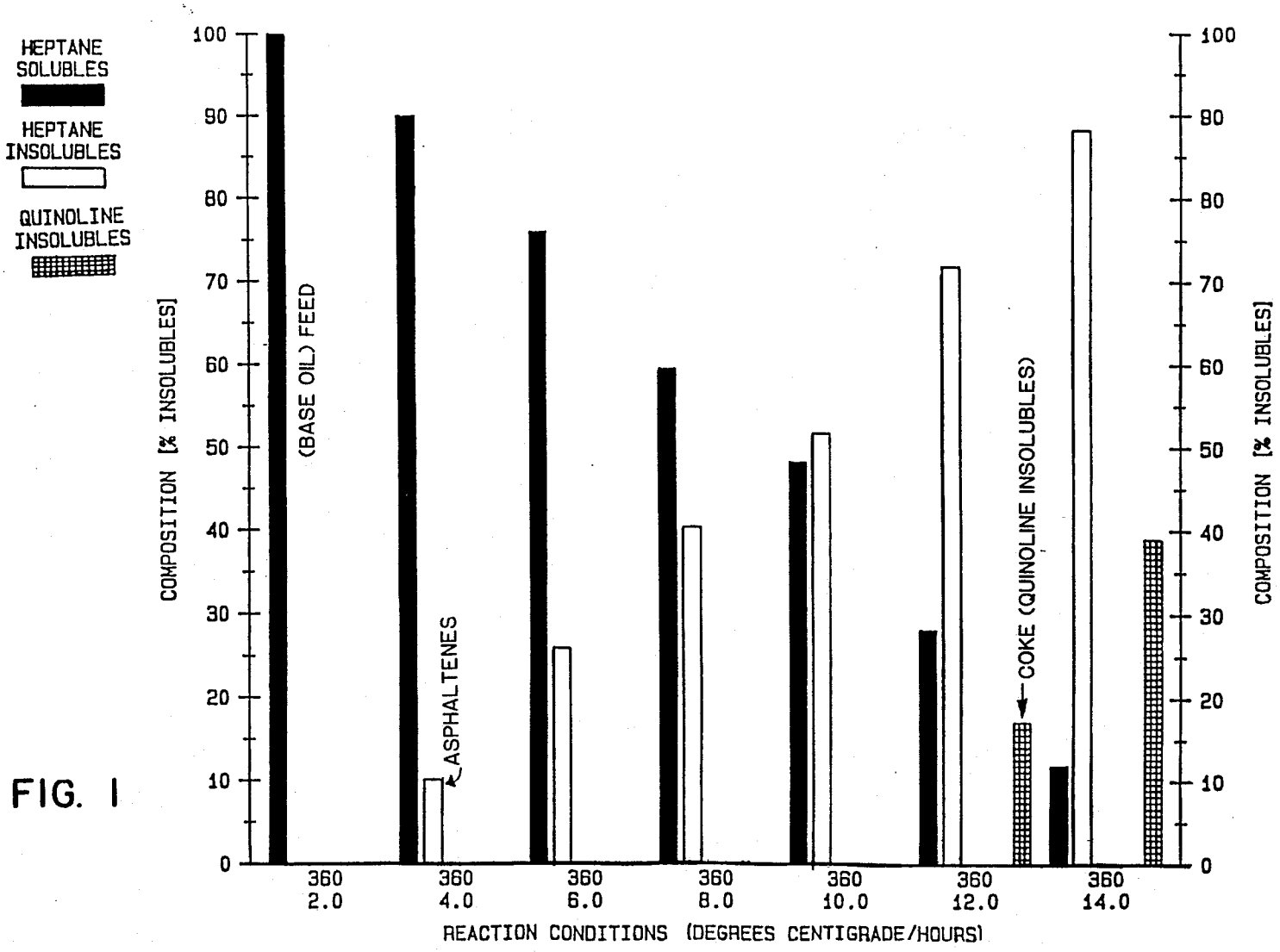
FIG. 1 illustrates the transformation of oil precursors into asphaltenes as a function of time.

The invention is based upon the principle that coke precursors can be identified and removed from the baseoils so as to result in baseoils of low oxidative reactivity.

As noted above, the particular precursors which have been identified and which are removed according to the invention are in the form of asphaltenes, particularly $C_7$-asphaltenes.

High oxygen content in the oil and the carbonaceous material present indicates that oxidative-polymerization of the baseoils is responsible for the ultimate formation of the carbonaceous material in the lube oil and the deposition on the wall of the piston.

Further investigation of the mechanism of carbon formation in lube oils led to the discovery that, on air oxidation of a baseoils, paraffin-insoluble compounds-asphaltenes- are the first molecular species formed from the precursors in baseoils upon oxidation, and that these asphaltenes are transformed gradually into carbonaceous material containing high infusible coke (quinoline insolubles). Amongst the wide range of paraffin insolubles which are formed upon heating and oxidation, the heptane insolubles, hereinafter designated as $C_7$-asphaltenes, are of particular interest.

Asphaltenes generally are composed of carbon, hydrogen, oxygen, and sulfur, with a C:M atomic ratio of 1.0-1.5, and an average molecular weight of about 250-1,000. They are brownish solids with melting points of 100°-400° C., with extremely high tendency to coke formation at 200°-300° C. in a non-oxygen nitrogen atmosphere, with a coke yield of 35-55% over two hours. The asphaltenes have a decomposition temperature of about 400° C., as determined by thermogravimetric analysis in nitrogen.

During oxidative-polymerization of the baseoil at high temperatures, e.g., 240°-360° C., portions of the baseoils will react with oxygen, leading to polymerization and introduction of various oxygen functional groups, such as phenolic, hydroxyl, carboxyl, ketones, aldlehydes, ethers, etc. Other polar atoms such as sulfur and nitrogen are also present. These high molecular weight, highly oxidized molecules become insoluble in aliphatic solvent.

According to the invention, asphaltene formation is accelerated such that the coking precursors which may then be removed are formed by subjecting the baseoil to conditions which accelerate the formation of asphaltenes in shorter periods of time than would normally occur if the oil is merely allowed to rest while exposed to air. The asphaltenes which have thus been formed are then removed from the baseoil. The asphaltenes can be formed thermally or oxidatively.

In oxidative polymerization of the baseoil at high temperatures, e.g., 240°-360° C., portions of the baseoils will react with oxygen, leading to polymerization and introduction of various oxygen functional groups, such as hydroxyl, carboxyl, ketones, etc. The high molecular weight, highly oxidized molecules become insoluble in aliphatic solvents. These insoluble portions are referenced as asphaltenes.

The formation, in an initially asphaltene-free baseoil (150CS) of $C_7$-asphaltene and quinoline insolubles (coke) by subjecting the baseoil to air-oxidation at 360° C. (oil temperature) is illustrated graphically in FIG. 1. The transition of precursors to substantially asphaltene (about 75%) prior to the onset of coke formation should be noted.

Regarding $C_7$-asphaltene formation and baseoil oxidation, it has been discovered that the content of volatile fraction and/or low boiling fractions in the baseoil is directly related to asphaltene formation.

Figure 2:
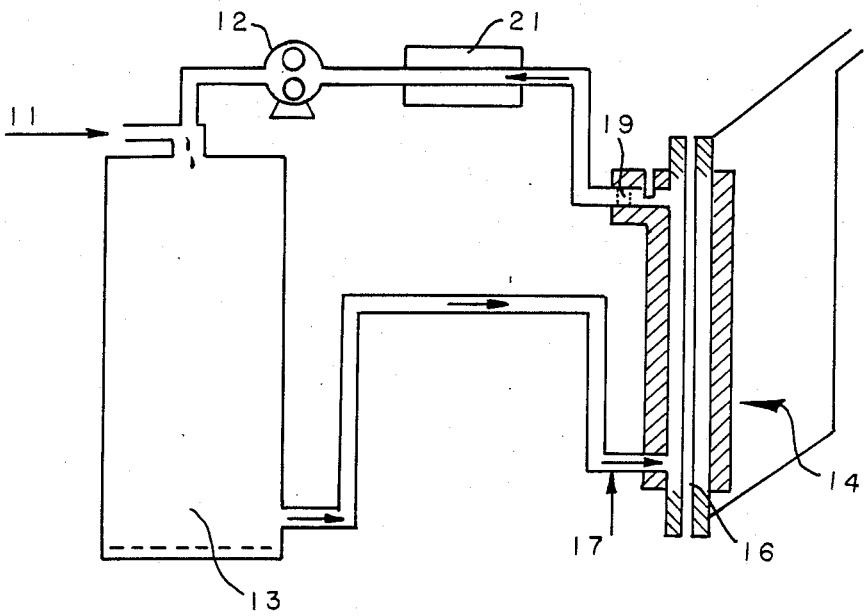
FIG. 2 illustrates one apparatus for accelerating asphaltene formation.

According to the invention accelerated thermal oxidation may be performed in one type of apparatus such as an "Alcor High Temperature Deposition Tester". Apparatus which may be used is schematically shown in FIG. 2 by circulating oil under a nitrogen blanket 11 with a constant speed metering pump 12 for 12 hours around a heat exchanger 14 in the form of a 10 inch high carbon steel tube 16. The bottom of the heat exchanger is maintained at 600° C. up to about 730° C. at various points along the heater. The oil is heated to 325° C. in preheater 13 before pumping at a rate of 3 cc/min. and air is injected at 17 at a rate of 1,000 cc/min. The circulation is performed so as to maximize contact.

Asphaltenes which are formed are trapped by filter 19 after which the oil is cooled by cooler 21. The invention is not limited as to the specific technique which is used to accelerate asphaltene formation, and specifically $C_7$-asphaltene formation, and may, for example, extend to other conditioning methods, e.g., the baseoils may be conditioned catalytically. When conditioning catalytically, catalysts are selected from the group consisting of: ferric chloride hexahydrate; cobalt octoate; iron naphthenate, stannic chloride and other oxidation catalysts, and mixtures thereof. These catalysts are used in conjunction with other techniques so as to further accelerate asphaltene formation. When using catalysts temperatures on the order of 180°–200° C. may be used.

The invention is further directed to accelerating asphaltene formation by the addition of compounds selected from the group consisting of peroxides, hydroperoxides, oxidized lube oils, and mixtures thereof. When added in effective amounts the substances serve to reduce asphaltene reaction times and temperatures, thereby accelerating asphaltene formation in the baseoils. The compounds are added in an amount of about 0.1 to about 0.5 by weight per hundred weight of the baseoil.

Figure 3:
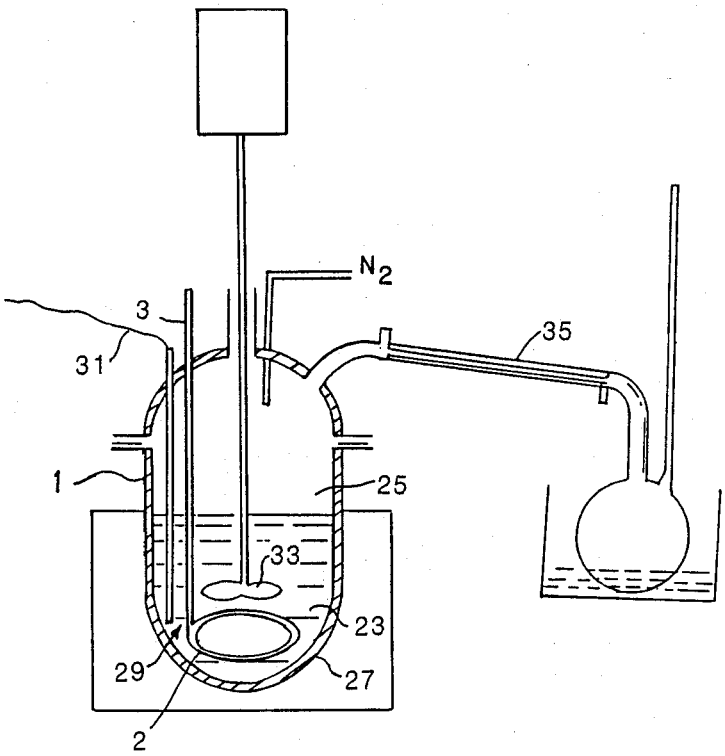
FIGS. 3, 3*a* and 3*b* show a second embodiment of an apparatus useful for accelerating asphaltene formation.

FIG. 3 illustrates a second embodiment of an apparatus useful for performing such a technique. As seen from this figure, the accelerated oxidation process of the invention is performed by heating a baseoil in a system wherein baseoil 23, maintained under an inert nitrogen floating (blanketing) seal 25 in reactor 27, is aerated by means of a specially designed sparger tube 29, and heated to a specified temperature, controlled by thermocouple 31. A high speed (500–600 RPM) mechanical agitator 33 which is essential for gas-liquid reactions ensures maximum liquid-gas contact. A condensation reflux system 35 for condensing volatilized hydrocarbons is also provided. Samples are routinely withdrawn and checked for paraffinic-insoluble content (asphaltenes).

Figure 3A:
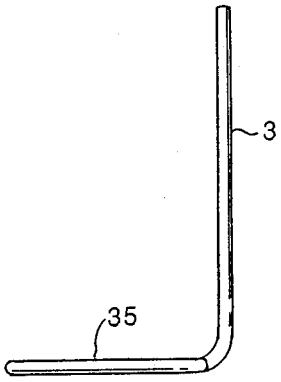
Figure 3B:
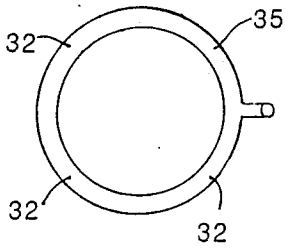

As shown in FIGS. 3*a* and 3*b* the sparger includes four orifices 32 equiangularly distributed on the upper surface of sparger ring 35. The upper surface of the sparger ring is located approximately one inch beneath the agitator blades 33. An inert gas such as nitrogen, carbon dioxide, helium and mixtures thereof may also be incorporated into the gas.

The apparatus illustrated is obviously more suitable for batch operation with smaller quantities of baseoil.

The asphaltenes formed, regardless of the technique used, may then be separated by any commercial removal technique such as distillation (atmospheric, vacuum or steam). Vacuum and steam distillation are performed at 1–100 mm.Hg. The temperature at which distillation is performed varies as a function of the substance actually being distilled although it is generally on the order of about 200°–800° C. (760 mm.Hg.) whereby the non-distillable asphaltenes are left behind and discarded.

In another embodiment of the invention the heptane insoluble precursors are removed by a solvent extraction. Such a technique has previously been proposed for other purposes in U.S. Pat. No. 4,431,512, and is a technique used in IP 142.

In this technique the precursors are converted to asphaltenes which are then contacted in the liquid phase with an "antisolvent" for the asphaltenes in a manner whereby the asphaltene is removed from the oil. The antisolvent can be any solvent or mixture of solvents, e.g. polar and hydrocarbon solvents containing 4–12 carbons, and may be branched, linear or cyclic, e.g., n-heptane, isooctane, n-hexane, petroleum ether, etc., and mixtures thereof, the most preferred material being n-heptane. The solvent selected must result in precipitation of the asphaltenes and be miscible with the baseoil. The antisolvent and oil are contacted at temperatures ranging from ambient to approximately 105° C. and are agitated until removal has occurred to a sufficient degree. The preferred feed: antisolvent ratio is 1:10–50, most preferably 1:30–40.

Contact may be performed within an agitator so as to achieve maximum liquid/liquid admixture. Once sufficient precipitation has occurred separation is achieved by centrifugation or filtration on a medium such as frittered glass, paper or cloth. The insolubles, when using filtration, are filtered out, with the heptane being separately removed.

Figure 4:
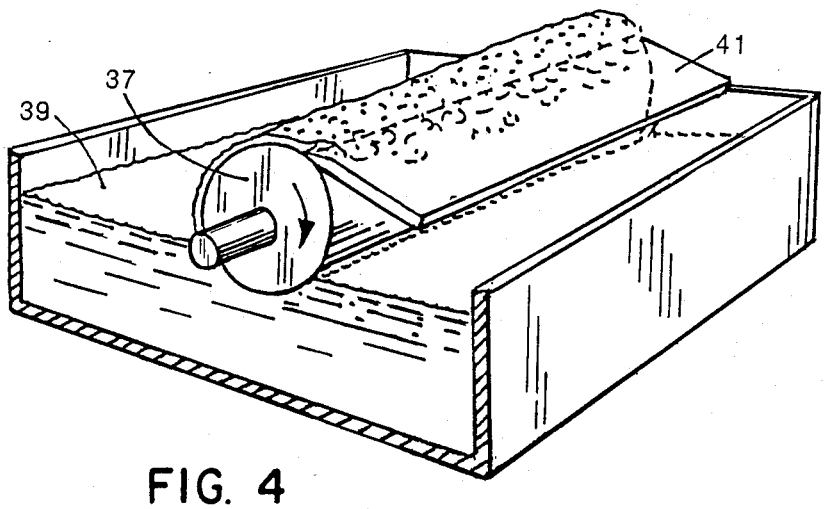
FIG. 4 illustrates yet another apparatus for removing asphaltenes.

In a more commercial technique, the oil being pretreated is passed through an apparatus of the type shown in FIG. 4. In this apparatus a cylinder 37, heated to a temperature of 240°–260° C., is partially submerged in an oil sample reservoir 39. The upper surface of the cylinder is progressively exposed to air as it is rotated. Depending upon the perameters of the treatment, the cylinder is either scraped continuously or intermittently by means of a doctor blade 41. As previously, perameters sometimes may be varied by the use of catalysts in the oil. When using a catalyst temperatures as low as 180°–280° C. may be used.

Figure 5:
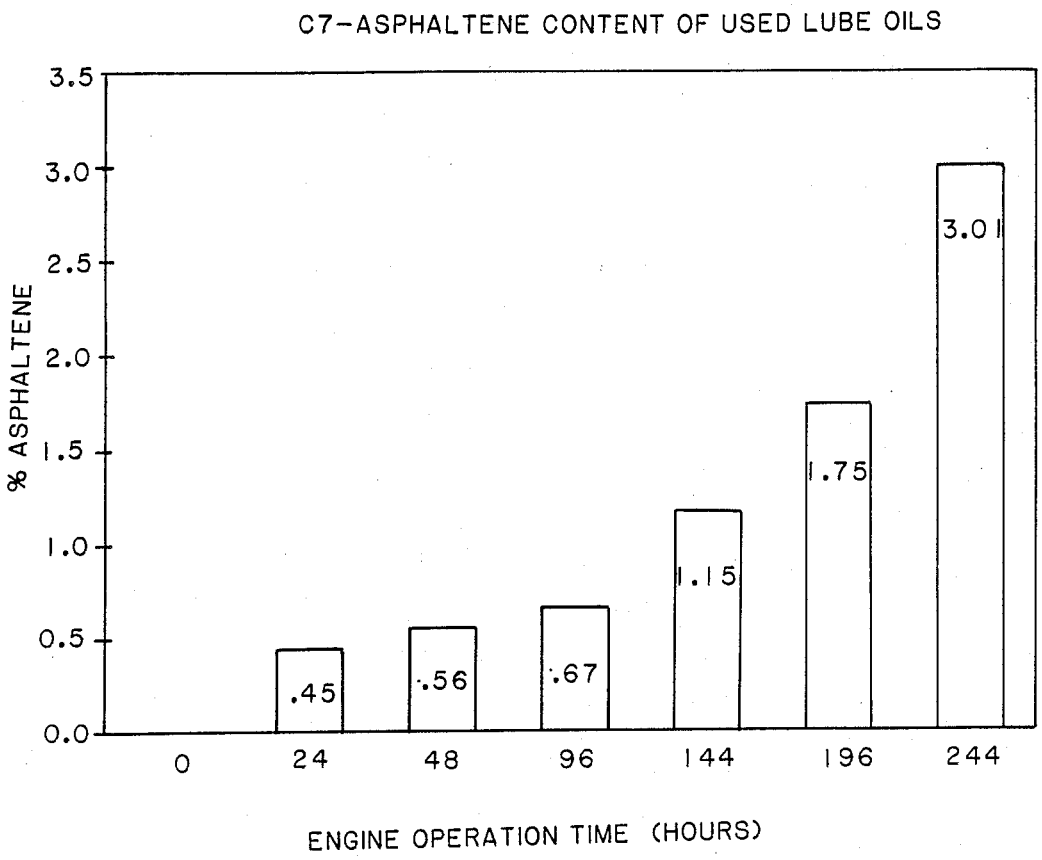
FIG. 5 illustrates the role of asphaltene formation as a coke precursor in engine testing.

The value of asphaltene removal as a technique of reducing coke formation in piston lubricating oils is shown clearly in FIG. 5 wherein the percentage of asphaltene present is indicated as a function of time of engine operation. A commercial oil is used with no inhibitors or additives.

The tests were performed on a catapillar 1Y540 engine in a performance test known as a "1J Test". The engine was operated for 244 hours and the times shown in the graph are the amounts of time that the oil was run in the engine before removal of the engine for testing.

This information coupled with the conversion data for asphaltene into coke reported above, makes abundantly clear the value of asphaltene removal in baseoils.

The following Examples establish the advantages of removing coking precursors from baseoils.

EXAMPLES 1 AND 2

Repeated Testing pf Lubricating Baseoils

Lubricating Baseoils (150 LP and 600N) were tested using Alcor's high temperature deposition tester using the following operating conditions:

Test time-12 hours
Air rate-1000 cc/min
Heater tube-carbon-steel
Oil-in Temperature-325° F.
Heater Tube Temperature Bottom Part (°F.)-600

At the end of the test, the heater tube was removed from the heat exchanger. The carbonaceous deposit and the demerit rating of the tube was determined.

The used heater tube was replaced with a clean tube and the test was repeated using the oil used in the first. Again the test was ran for 12 hours at the same conditions as in the first test. The heater tube was then removed, and the carbonaceous deposits on the tube and the demerit rating of the tube were determined.

The used heater tube was replaced with a clean tube and the test was repeated for the third time using the used oil from the second test.

Test data clearly indicates that the carbonaceous deposits and the heater tube demerit rating are significantly reduced in the second and third tests, i.e., after the removal of the majority of the deposit precursors in the first test.

| | FIRST RUN | | SECOND RUN | | THIRD RUN | |
|---|---|---|---|---|---|---|
| Base Oil | Carbon Deposits (MG) | Deposit Demerit Rating | Carbon Deposits (MG) | Deposit Demerit Rating | Carbon Deposits (MG) | Deposit Demerit Rating |
| Example 1 | | | | | | |
| 150 LP | 212 | 249 | 53 | 55 | 7 | 4.7 |
| Example 2 | | | | | | |
| 600 N | 46 | 44.5 | 23 | 24 | 4 | 1.9 |

EXAMPLES 3, 4, 5 and 6

REO oils 212, 216, 203 and 214 were tested using Alcor High Temperature Deposition tester at the same operating conditions used in Examples 1 and 2.

The test were repeated twice. The carbonaceous deposits on the heater tubes and the demerit rating of the tubes were determined after each test.

Test data clearly indicates that deposit formation is reduced significantly in the second test after removing the deposit precursor in the first test.

| | | FIRST RUN | | SECOND RUN | |
|---|---|---|---|---|---|
| | REO No. | Carbon Deposits (MG) | Deposit Demerit Rating | Carbon Deposits (MG) | Deposit Demerit Rating |
| Example 3 | 212 | 27.0 | 12.7 | 8.0 | 3.4 |
| Example 4 | 216 | 11.0 | 4.3 | 4.0 | 1.9 |
| Example 5 | 203 | 12.0 | 3.2 | 5.0 | 2.1 |
| Example 6 | 214 | 7.0 | 3.1 | — | — |

Although the invention has been described with reference to particular means, materials and embodiments, it is to be understood that the invention is not limited to the particulars disclosed and extends to all equivalents within the scope of the claims.

What is claimed is:

1. A method of producing lubricating oil baseoil having a reduced coking tendency comprising the steps of:

(a) subjecting said baseoil to conditions which accelerate formation of asphaltene coking precursors in said baseoil, said conditions comprising oxidizing said baseoil by sparging said baseoil with an oxidizing gas selected from the group consisting of air, oxygen; ozone, nitrogen oxides, sulfur oxides, and mixtures thereof; and (b) removing asphaltene formed in step (a) from said baseoil by contacting said baseoil with a liquid antisolvent, said liquid antisolvent being miscible with said baseoil and having a higher insolubility for said asphaltene than said baseoil has for said asphaltene whereby said asphaltene is precipitated.

2. The method as defined by claim 1 wherein the asphaltene formed in step (a) is $C_7$-asphaltene.

3. The method as defined by claim 2 wherein asphaltene formation is accelerated in step (a) by oxidizing and heating said baseoil.

4. The method as defined in claim 3 wherein asphaltene formation is accelerated in step (a) by continuous oxidation at approximately 180°–260° C.

5. The method as defined by claim 4 comprising incorporating an inert gas into said oxidizing gas, said inert gas being selected from the group consisting of nitrogen, helium, carbon dioxide, and mixtures thereof.

6. The method as defined by claim 5 comprising agitating said baseoil during said sparging with a mechanical agitator.

7. The method as defined by claim 1 wherein said antisolvent comprises at least one polar liquid.

8. The method as defined by claim 1 wherein said antisolvent comprises at least one hydrocarbon liquid.

9. The method as defined by claim 1 wherein said antisolvent comprises a blend of at least one polar and at least one hydrocarbon liquid.

10. A method of producing lubricating baseoil having a reduced coking tendency comprising the steps of:

(a) subjecting said baseoil to conditions which accelerate formation of asphaltene coking precursors in baseoil, said conditions comprising catalytic reaction of said baseoil by exposing said baseoil to a catalyst selected from the group consisting of cobalt octoate, iron naphthenate, stannic chloride, and mixtures thereof; and (b) removing asphaltene formed in step (a) from said baseoil by contacting said baseoil with a liquid antisolvent which is miscible with said baseoil and has a higher insolubility for said asphaltene than said baseoil has for said asphaltene whereby said asphaltene is precipitated.

11. The method as defined by claim 10 wherein said catalytic reaction is performed by further exposing said baseoil to a material selected from the group consisting of peroxides, oxidized lube oils, and mixtures thereof.

12. The method as defined by claim 10 comprising heating said baseoil during said catalytic reaction at a temperature of 180° to 280° C.

13. The method as defined by claim 10 comprising sparging said baseoil during said catalytic reaction with an oxidizing gas selected from the group consisting of air, oxygen, ozone, nitrogen oxides, and sulfur oxides.

14. The method as defined by claim 13 comprising incorporating an inert gas into said oxidizing gas, said inert gas being selected from the group consisting of nitrogen, carbon dioxide, helium and mixtures thereof.

15. The method as defined by claim 10 wherein said antisolvent comprises at least one polar liquid.

16. The method as defined by claim 10 wherein said antisolvent comprises at least one hydrocarbon liquid.

17. The method as defined by claim 10 wherein said antisolvent comprises a blend of at least one polar and at least one hydrocarbon liquid.

18. A method of producing lubricating oil baseoil having a reduced coking tendency comprising the steps of:

(a) subjecting said baseoil to conditions which accelerate formation of asphaltene coking precursors in said baseoil, said conditions comprising reacting with said baseoil a material selected from the group consisting of peroxides, hydroperoxides, oxidized lube oils, and mixtures thereof; and (b) removing asphaltene formed in step (a) from said baseoil by contacting said baseoil with a liquid antisolvent which is miscible with said baseoil and has a higher insolubility for said asphaltene than said baseoil has for said asphaltene whereby said asphaltene is precipitated.

19. The process as defined by claim 18 comprising sparging said baseoil during said reaction with an oxidizing gas selected from the group consisting of air, oxygen, ozone, nitrogen oxides, sulfur oxides, and mixtures thereof.

20. The process of claim 19 comprising incorporating an inert gas into said oxidizing gas, said inert gas being selected from the group consisting of nitrogen, carbon dioxide, helium, and mixtures thereof.

21. The method as defined by claim 18 wherein said antisolvent comprises at least one polar liquid.

22. The method as defined by claim 18 wherein said antisolvent comprises at least one hydrocarbon liquid.

23. The method as defined by claim 18 wherein said antisolvent comprises a blend of at least one polar and at least one hydrocarbon liquid.

24. A method of producing a lubricating oil baseoil having a reduced coking tendency comprising accelerating asphaltene coking precursor formation in said baseoil by exposing said baseoil to a heated roller in rotating contact with said baseoil, and heating said baseoil to a temperature effective to accelerate asphaltene formation by means of said roller whereby asphaltene formed in said baseoil deposits on said heated roller, and removing asphaltene from said roller.

25. The method as defined in claim 24 comprising removing asphaltene from said roller by doctering asphaltene off of said heated roller with a doctor blade.

26. A method of producing a lubricating oil baseoil having a reduced coking tendency comprising accelerating asphaltene coking precursor formation in said baseoil by contacting said baseoil with a stationary heated tube, and removing asphaltene by filtering said asphaltene out of said baseoil.

* * * * *